US005304104A

United States Patent [19]

Chi

[11] Patent Number: 5,304,104

[45] Date of Patent: Apr. 19, 1994

[54] DYNAMIC RESISTANCE DEVICE FOR A PHYSICAL EXERCISER

[76] Inventor: Wu H. Chi, No. 1-2, Lane 975, Chun-Jih Road, Tao-Yuan City, Taiwan

[21] Appl. No.: 74,382

[22] Filed: Jun. 10, 1993

[51] Int. Cl.[5] ..... A63B 21/00

[52] U.S. Cl. ..... 482/1; 482/99; 482/115; 482/903

[58] Field of Search ..... 482/1-9, 482/99, 102, 115-119, 903; 128/25 R

[56] References Cited

U.S. PATENT DOCUMENTS

| | | | |
|---|---|---|---|
| 3,372,928 | 3/1968 | Showalter | 482/903 X |
| 3,640,530 | 2/1972 | Henson et al. | 482/116 |
| 4,479,647 | 10/1984 | Smith | 482/903 X |
| 4,537,396 | 8/1985 | Hooper | 482/8 |
| 4,538,595 | 9/1985 | Hajianpour | 128/25 R |
| 4,678,184 | 7/1987 | Neiger et al. | 482/903 X |
| 4,747,595 | 5/1988 | Mabry et al. | 482/99 |
| 4,979,733 | 12/1990 | Prod'Hon | 482/116 X |
| 5,090,694 | 2/1992 | Pauls et al. | 482/119 X |
| 5,133,545 | 7/1992 | Moschetti et al. | 482/903 X |
| 5,180,348 | 1/1993 | Saarinen | 482/903 X |

*Primary Examiner*—Robert Bahr

*Attorney, Agent, or Firm*—Morton J. Rosenberg; David I. Klein

[57] ABSTRACT

A dynamic resistance device for an exerciser, comprises a bracket; an actuating device which is mounted within said bracket, which includes a motor and an output shaft; a winch which includes a winding drum and a cable, the winding drum is extended coaxially with a first rotating shaft and a second rotating shaft, as the winding drum rotates, the first and second rotating shaft will rotate consequently, one end of the cable is fixed on the winding drum, and the cable is wound within a spiral slot of the winding drum; a reduction device includes a first timing wheel and a second timing wheel, the first and second timing wheel are connected with a timing belt, the timing wheel is fixed on the output shaft of the motor, and the second timing wheel is fixed on the first rotating shaft which is connected to winding drum; a fairleader includes a stopping plate and a rubber ball, stopping plate is bridged on the top of bracket and has a slot thereof, the cable can pass through the slot freely, the diameter of the rubber ball is larger than the width of the slot, hence the rubber ball will be limit thereon as the cable is retrieved into the winding drum; and a cover which can be attached to the bracket to prevent dirt and debris.

10 Claims, 6 Drawing Sheets

DYNAMIC RESISTANCE DEVICE FOR A PHYSICAL EXERCISER

FIELD OF THE INVENTION

This invention relates to a dynamic resistance device and, particularly, to a dynamic resistance device for a physical exerciser.

At present, the physical exerciser used for body build-up is shown in FIG. 1. The physical exerciser M of prior art comprises a main structure which takes a counterweight or a rubber pad to create a certain resistance to the user. It can be concluded with the following defects.

1. As the user tries to increase or decrease the resistance, he must stop his exercise first, then make an adjustment by adding or reducing the counterweight S attached. This adjustment takes time and interrupt the continuity of the exercise. The effect of exercise is largely decreased.

2. As the prior art uses the iron blocks S as the counterweight, it is too heavy for the user to make a precise adjustment. The user can not select a pre-determined resistance as his/her exercising goal. Again, the effect of exercise is largely decreased.

3. As the counterweight drops to its original position, it creates a great deal of noise since it collides with other counterweights. Not only will it make a noise to the other user, it is also uncomfortable to the user himself.

It is the primary object of this invention to provide a dynamic resistance device which is configured with a simple structure. Besides, the resistance of this resistance device can be precisely selected to increase the effect of the exercise.

It is still the object of this invention to provide a dynamic resistance device wherein the resistance can be pre-determined through a computerized panel.

In order to achieve the above described objects, the present invention is embodied with a DC motor. Since the torque of the motor has a linear relationship with the current of the motor, the torque can be determined by the following equation.

$$T=K*O*N*I,$$

where

K is a constant,
N is the total windings of coils,
T represents torque,
O represents the total magnetic flux, and
I is the current.

Since the K, O and N are constants, it can be seen that the relationship between T and I is linear. Hence output torque remains constant, if the motor is supplied with a constant current. If a counter rotating torque is applied to the output shaft of the motor, the shaft of the motor will rotate with a counter direction. As a result, the torque generated by the input current will become a resistance to the user who works against the torque. If the externally applied torque is released, the motor resumes to its original direction. In summary, the counterweights can be easily replaced by the torque generated by the DC motor.

This dynamic resistance device features with a compact structure at one hand, and the load can be easily selected on the other hand. Besides, the rotation of the DC motor make very little noise. It can provide a very comfortable exercising environment for the user.

Furthermore, the dynamic resistance device can be connected to a programmable controller which selects a workout profile. It sends send a digital/analog signal to control the input current of the motor. Then the resistance is changed smoothly according to the workout profile.

BRIEF DESCRIPTION OF THE DRAWINGS

The attached figures are briefly described as follow.

Figure 1:
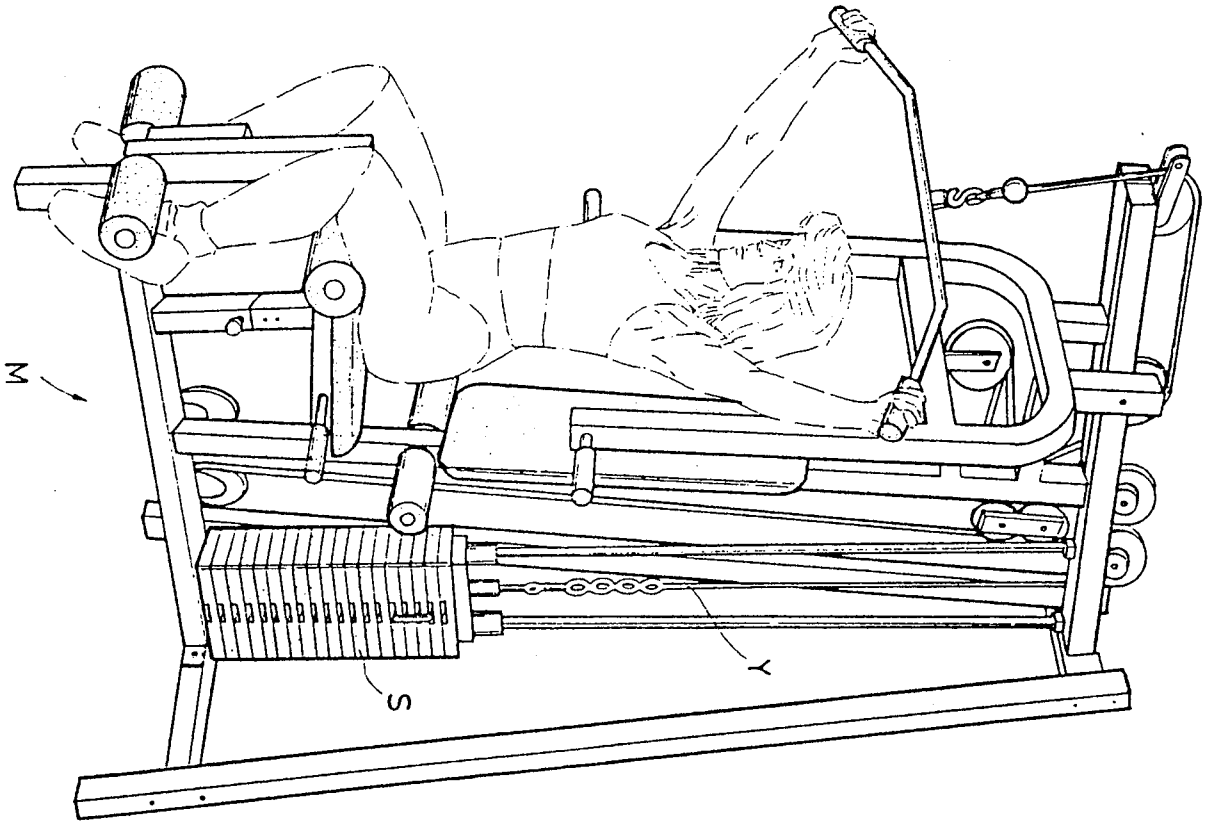
PRIOR ART FIG. 1
FIG. 1 is a perspective view of a mechanical exerciser of prior art.
Figure 2:
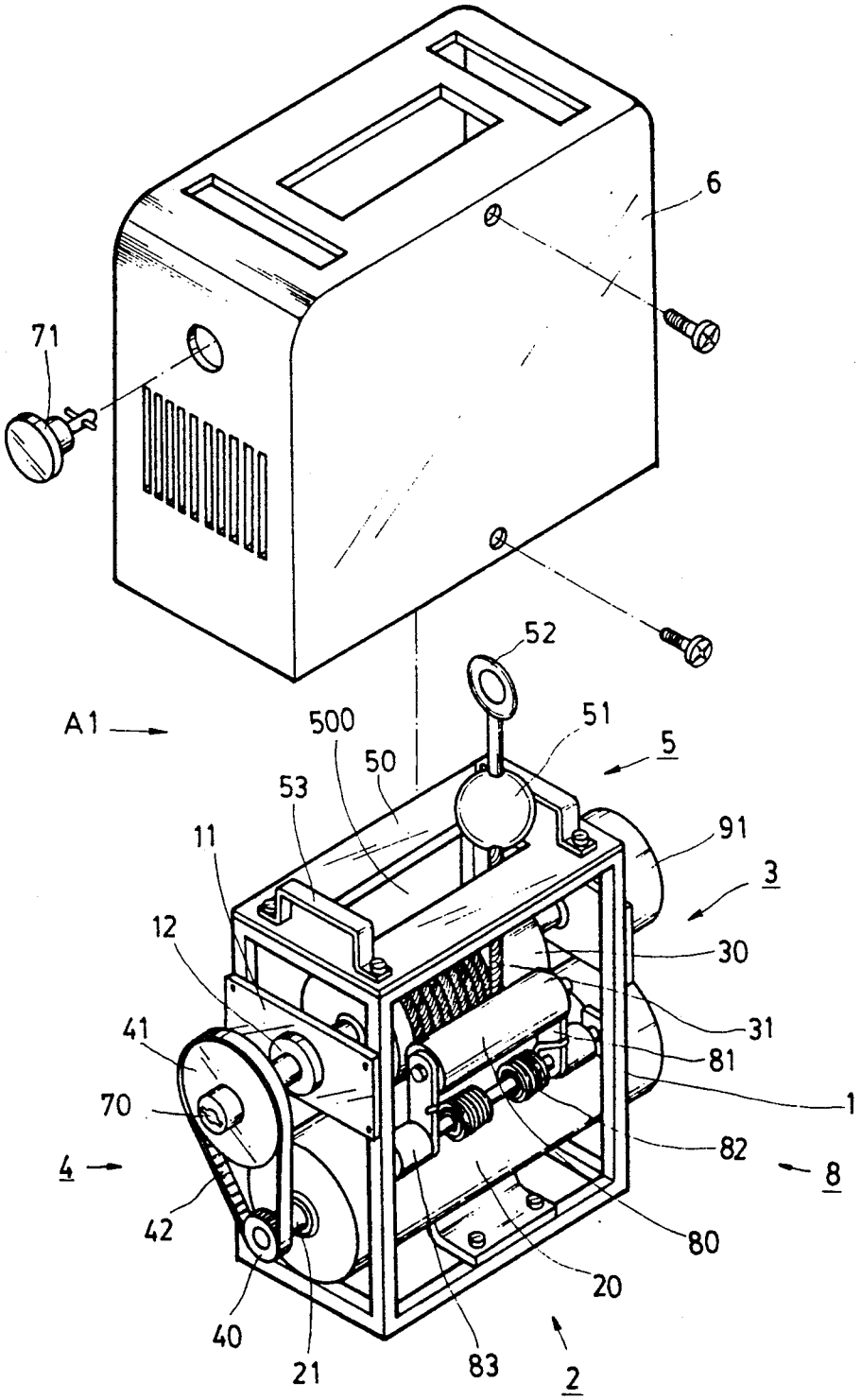
FIG. 2 is a perspective view showing a dynamic resistance device for a exerciser made according to the present invention thereof.
Figure 3:
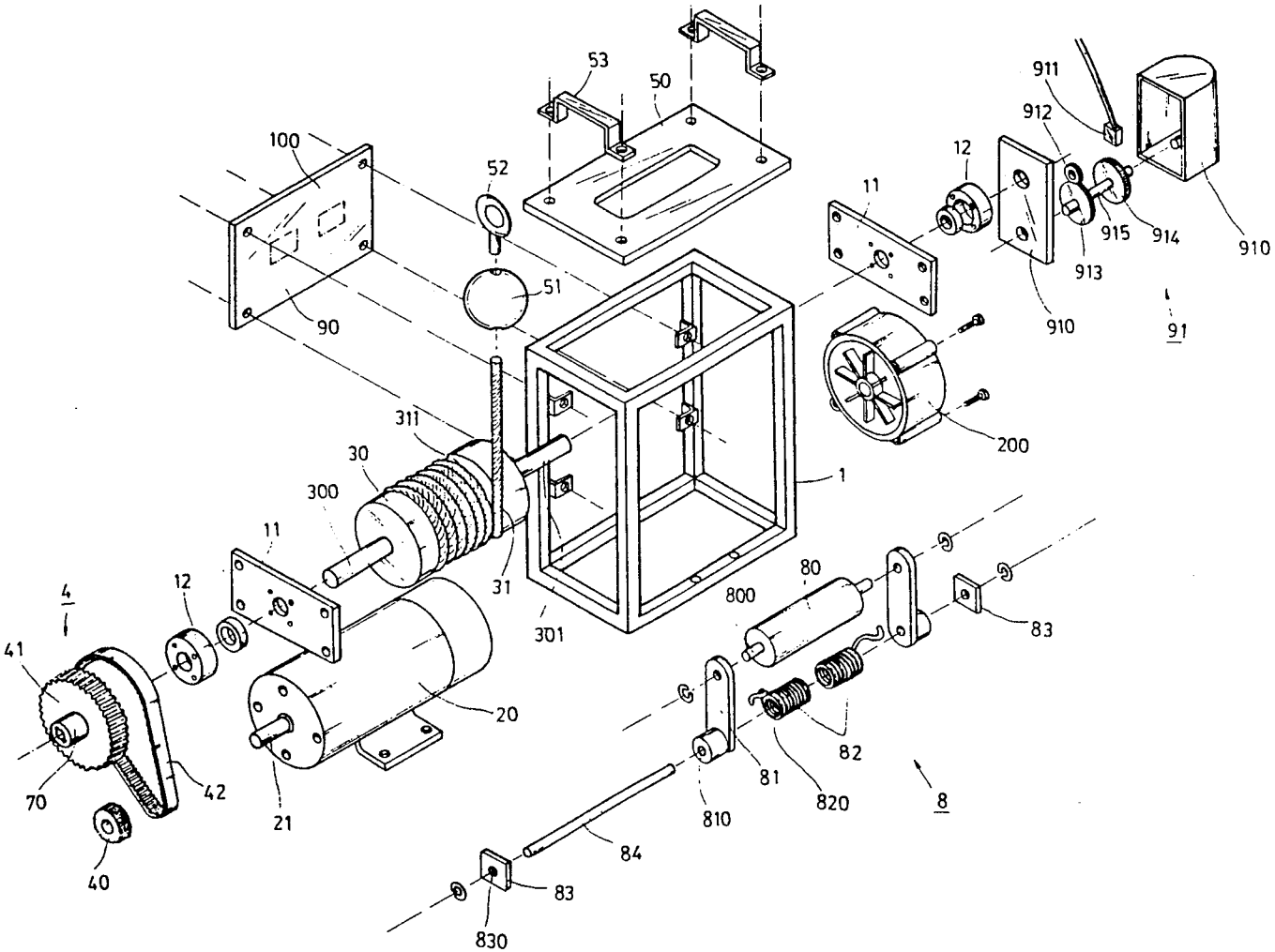
FIG. 3 is an exploded perspective view showing a dynamic resistance device made according to the present invention thereof.

Please refer to Figures, and particularly to FIGS. 2 and 3. This dynamic resistance device A1 is embodied with a bracket 1, an actuating device 2, a winch 3, a reduction device 4, a fairleader 5 and a housing 6. Said actuating device 2 which includes a DC motor 20, and an output shaft 21 is installed within the inside of bracket 1. Said motor 20 can be installed with a fan 200 for cooling. Said winch 3 is bridged on the side plate 11 of said bracket 1 by two bearing 12 fixed on the side plate 11. The winch 3 includes a winding drum 30 and cable 31. Said winding drum 30 is extended coaxially with a first rotating shaft 300 and a second rotating shaft 302. As said winding drum 30 rotates, said rotating shaft 300, 301 will rotate consequently. One end of said cable 31 is fixed on said winding drum 30. Then said cable 31 is wound within the spiral slot 311 of said winding drum 30. Said reduction device 4 includes a first timing wheel 40 and a second timing wheel 41, said first and second timing wheel 40, 41 is connected with a timing belt 42. Said timing wheel 40 is fixed on the output shaft 21 of said motor 2, and said second timing wheel 41 is fixed on the first rotating shaft 300 connected with said winding drum 30. As said motor 2 rotates, said winch 3 will be driven to rotate via the connection mechanism constructed by said first timing wheel 40, said second timing wheel 41 and said timing belt 42. A fairleader 5 is fixed on the other end of said cable 31 to avoid the whole cable is wound by said winding drum 30. In this preferable embodiment, said fairleader 5 includes a stopping plate 50 and a rubber ball 51. Said stopping plate 51 is bridged on the top of said bracket 1 and has a slot 500 thereof. Said cable 31 can pass through said slot 500 freely. Since the diameter of said rubber ball 51 is larger than the width of said slot 500, hence said rubber ball will be limit thereon as the cable 31 is retrieved into said winding drum 30. On the other hand, a handle 53 is provided in said stopping plate 50 for a easy transportation of this device. A collar 52 is fixed on the free end of said cable 31, the position of said collar 52 is higher than said rubber ball 51. Said collar 52 can be connected with other cable linkage, such as the exerciser shown in FIG. 1. A cover 6 is provided to bracket 1 to protect said bracket 1 from dirt and debris drop in.

As above described, the relationship of torque T and input current I is linear, as said motor 20 is applied a steady current, the torque T output by said shaft 21 will remain constant value. As the user applies a pulling force on the collar 52, the cable 31 will be pull out from said winding drum 30. Thanks to the connecting mechanism constructed by said first timing wheel 40, said second timing wheel 41 and said timing belt 42, the pulling force will transmit to said motor 20 in the form of a counter torque. If the counter torque is larger than the torque T generated by said motor 20, then the motor 20 will be driven to rotate opposite to its original direction. As the pulling force is released, than said motor 20 resumes to its original direction and retrieves the cable 31 back to said winding drum 30. This above described device can successfully replace the counter weights S made of iron block. This device features with silence and simple structure.

Besides, a socket 70 is provided on the shaft of said second timing wheel 41, and a manual wheel 71 is inserter therein for manually rotating winding drum 30 to wind said cable 31 to said wind drum 30.

For easily winding of said cable 31, a guiding device 8 is provided adjacent to said winding drum 30. Said guiding device 8 includes a pressing roller 80, two supporting bracket 81, a spring member 82, two bearing socket 83 and a shaft 84. Said roller 80 has two installing shaft 800 extending outwardly for easily installment of said roller 80 to said supporting bracket 81. A through hole 810 is provided in the lower portion of supporting bracket 81 with respect to the through hole 820 of spring member 82 and the through hole 830 of said bearing socket 83. Said spring member 82 is bridged between said supporting bracket 81 and said shaft 84. As supporting bracket 81 rotates along said shaft 84, said spring member 82 will provide a return force to said supporting bracket 81. By this arrangement, said roller 80 will have a consistent contact with said cable 31 wound on said winding drum 30, pressing said cable 31 within said slot 311.

Figure 4:
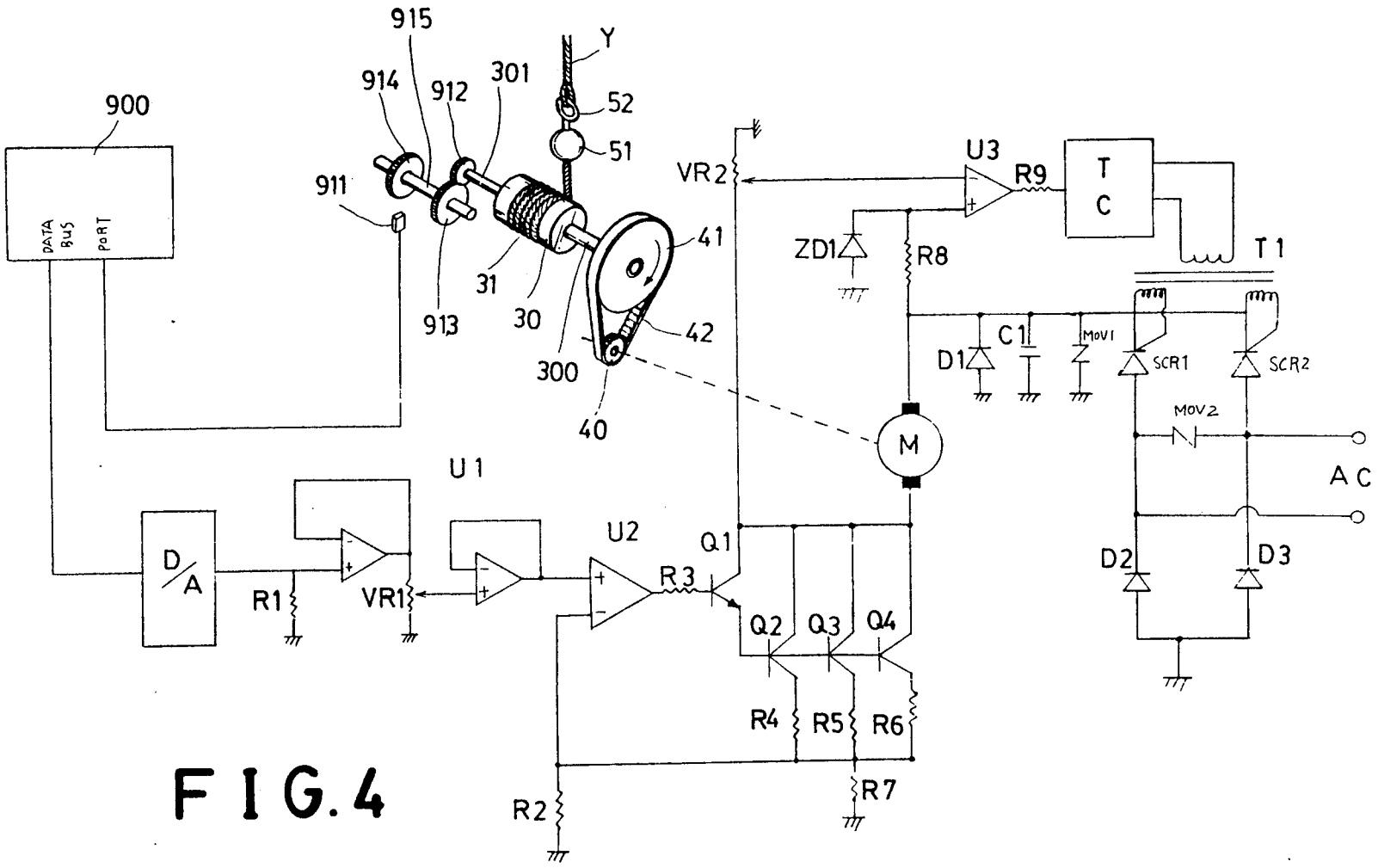
FIG. 4 is a circuit diagram of a computerized controller, wherein a dynamic resistance device is incorporated thereof.

For a easy control of this dynamic resistance device A1, a controlling circuit device 90 and an encoder 91 is incorporated. Said controlling circuit device 90 is attached on a printed circuit board 100 which is installed on said bracket 1. Referring to FIG. 4, a preferable embodiment of said controlling circuit device 90 is illustrated. This controlling circuit 90 is designed to adjust the input current I of said motor 20 so as to adapt the torque T generated by said motor 20. This setting can be done via a controlling panel 900 which can input a predetermined workout profile. Said controlling circuit device 90 includes a controlling panel 900, a digital-to-analog converter D/A, a buffer U1, a first comparator U2, a second comparator U3, a driving transistor Q1, three power transistor Q2–Q4, a fly-wheel diode D1, a filter capacitor C1, two surge absorber MOV1–2, a transformer T1, two silicone controlled rectifier SCR1–2, two rectified diode D1–2, and a triggering circuit TC. The SCR1–2, D2–3 jointly configured a bridge rectifier, which provides the current to said motor 20. Said MOV1–2 is used to protect SCR1–2. As motor 20 rotates oppositely, a induced voltage will be generated, and this inducted voltage will construct a loop via Q2–Q4 and D1.

The encoder 91 includes a housing 910, a sensor 911, a first gear 912, a second gear 913, a magnet 914 and a linkage 915. Said first gear 9 is mounted on second rotating shaft 301 of said winding drum 30. Said first gear 912 is rotated with said linkage 915 and magnet 914, which hundreds of magnetic poles are magnetized on the circumference of the magnet. Said linkage 915 is bridged on said housing 910 and caused said first gear 912 and said second gear 913 meshed together. Said sensor 911 is designed to detect said magnet 914, and to send a detected signal to the input port of said controlling panel 900, this signal is used as a parameter to calculate the equivalent workout distance and calories burned.

The controlling panel 900 will send out a 8-bit signal to said digital-to-analog converter D/A. Then to the buffer U1 and to said first comparator U2. As first comparator U2 receives this signal, the comparator U2 will compare this signal with the feedback signal provided by motor 20. If the analog signal is larger than the feedback signal, it means the current I of motor 20 is lower than the predetermined current. Then the output of said first comparator U2 is high, enabling Q1, Q2–Q4 to be closed. The current flows through a balance resistor R4–R6 and feedback resistor R7. This signal is feedback through connection point A to increase the feedback signal. If the feedback signal is larger than the analog signal, said first comparator U2 is sending out a zero voltage, then Q1–Q4 is opened to lower the said current feedback signal. By this arrangement, the current delivered to said motor 20 is kept a constant.

On the other hand, said second comparator U3 is designed to control the triggering circuit TC of SCR. It will use the pulse transformer T1 to control the igniting angle of SCR. Between emittor and collector of Q2–Q4, there exists a high voltage drop, this will make the power transistors generate heat, and waste the energy. Hence, the provision of said second comparator U3 is used to keep voltage between the emittor and collector at a low level so as to reduce the consumption of said power transistor Q2–Q4.

Figure 5:
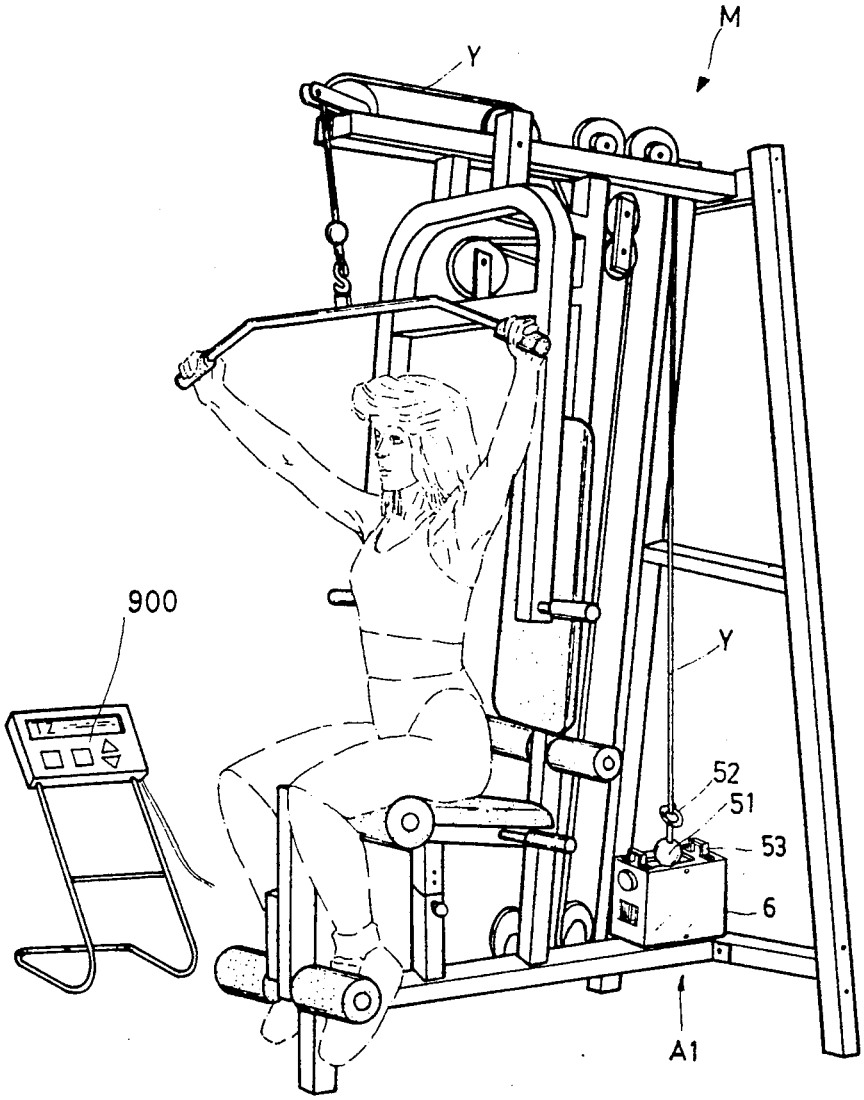
FIG. 5 is perspective view of a exerciser, wherein a dynamic resistance device is incorporated in the rear portion thereof.

The above described is the dynamic resistance device of this present invention. As shown in FIG. 5, an exerciser is incorporated with a dynamic resistance device A1 which can total substitute the iron block S. The pulling cable Y of said exerciser M can be connected with cable 31 via collar 52. As the rotation direction of said winch 3 is opposite to said motor 20, said motor 20 will provide a dragging torque to said winch 3. As the current input to the motor is increased, dragging torque will increase consequently. This dragging force is similar to said iron block S or elastic element. But it features with a silent environment which the prior can never provide. Besides, a workout profile can be predetermined through a controlling panel 900, this features the user with a continuous sport, but the resistance can be varied during the whole period.

Since the dynamic resistance device A1 can be easily installed/removed, hence it provides a excellent convenience to the user. It can be easily removed from one and installed to another, providing the user with more selections.

Figure 6:
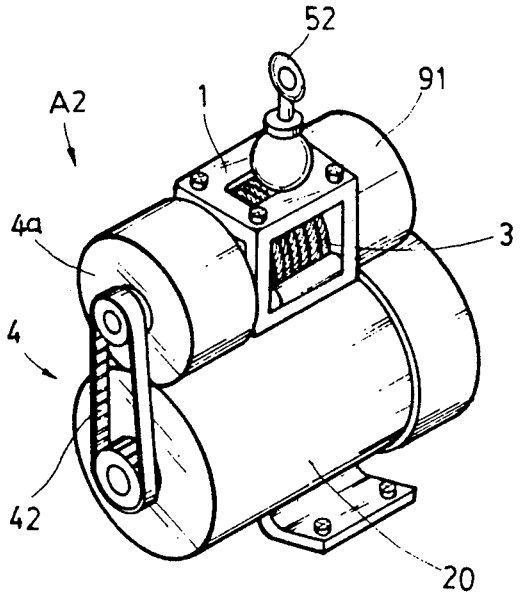
FIG. 6 is a second preferable embodiment of a dynamic resistance device made according to this present invention.

FIG. 6 is a second preferable embodiment of the dynamic resistance device made according to this invention. In this embodiment, a solar-planet gear system 4a is installed between the reduction device 4, driven by said timing belt 42, and winch 3. This solar-planet gear system provides a higher torque and has a higher reduction ratio. This can be installed to the exerciser which needs a larger torque.

Figure 7:
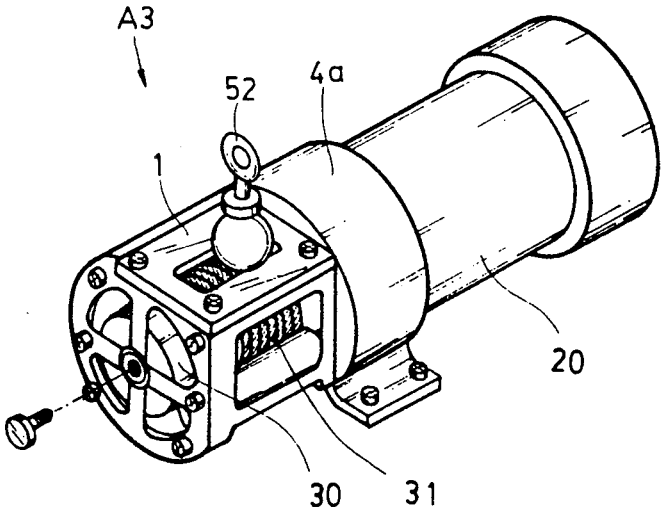
FIG. 7 is a third preferable embodiment of a dynamic resistance device made according to this present invention.

FIG. 7 is a third preferable embodiment, wherein the reduction gear box 4*a* is directly driven by said motor 20 and said timing belt 42 which is eliminated. By this arrangement, the height of the dynamic resistance device A1 is largely decreased. This embodiment can be fitted to the exerciser which occupies a small space.

Consequently, appended claims should not be limited to their literal terms, but shall be broadly controlled in the manner consistent with the significant advance, in the useful arts and sciences, to which the present invention appertains.

What I claim is:

1. A dynamic resistance system for an exercise machine comprising:

(a) a bracket frame;

(b) a winch mounted within said bracket frame including a winding drum and a cable, said winding drum having a first and second rotating shaft extending coaxially from opposing sides of said winding drum, said cable having one end coupled to said winding drum and matingly in contact with said winding drum within a helically contoured slot formed within an outer surface thereof;

(c) actuation means secured to said bracket frame for applying a resistive force load to a second end of said cable responsive to said cable being unwound from said winding drum, said actuation means including a motor having a motor output shaft extending therefrom;

(d) speed reduction means for reducing a rotative speed of said motor output shaft, said speed reduction means including a first and second timing wheel rotatively coupled each to the other by an endless timing belt, said first timing wheel being coupled to said motor output shaft and said second timing wheel being coupled to said first rotating shaft of said winding drum;

(e) cable guiding means for directionally guiding said second end of said cable responsive to a rotative displacement of said winding drum, said cable guiding means including a stop plate member having a longitudinally directed slot formed therethrough for passage therethrough of said cable, said slot having a predetermined width dimension, said second end of said cable having an elastic sphere mounted thereon, said elastic sphere having a diameter greater than said width dimension of said slot;

(f) a cover housing mounted over said bracket frame for substantially enclosing said bracket frame; and, (g) means for maintaining a force load on said cable within said helically formed slot of said winding drum when said cable is being wound and unwound from said winding drum.

2. The dynamic resistance system as recited in claim 1 where said cable guiding means includes at least one handle member fixedly coupled to a top surface of said stop plate member, said handle member extending through a cover slot formed through said cover housing.

3. The dynamic resistance system as recited in claim 1 where said second end of said cable includes a collar member secured thereto for releasable coupling to said exercise machine.

4. The dynamic resistance system as recited in claim 1 including means for manually rotating said winding drum external said cover housing.

5. The dynamic resistance system as recited in claim 4 where said means for manually rotating said winding drum includes a manual wheel actuating member insertable into a matingly engaging socket formed in an end of said second timing wheel.

6. The dynamic resistance system as recited in claim 1 where said means for maintaining a force on said cable includes:

(a) a pair of roller support brackets rotatively mounted to said bracket frame; and, (b) a pressing roller mounted respectively on opposing ends thereof to said roller support brackets, said pressing roller being spring biased into engagement with said cable mounted on said winding drum.

7. The dynamic resistance system as recited in claim 1 including gear reduction means coupled on opposing ends thereof to said second timing wheel member and said first rotating shaft of said winding drum for increasing a resistive torque loading of said motor.

8. The dynamic resistance system as recited in claim 1 where said motor is a DC motor coupled to said speed reduction means.

9. The dynamic resistance system as recited in claim 1 including:

(a) circuit control means formed on a printed circuit board mounted on said bracket frame for outputting a motor signal to said motor for establishing a predetermined motor electrical current responsive to said motor output signal; and, (b) a control panel coupled to said circuit control means for establishing a circuit control signal applied to said circuit control means.

10. The dynamic resistance system as recited in claim 9 including encoder means electrically coupled to said control panel and said second rotating shaft of said winding drum for providing an encoder output signal to said control panel responsive to a rotative displacement of said winding drum, said encoder means having a magnetic wheel member rotatively actuated responsive to a rotation of said winding drum second rotating shaft defining a plurality of discrete magnetic poles on a peripheral surface thereof and a pickup sensor adjacent said magnetic wheel member for providing said encoder output signal.

* * * * *